US007090893B1

(12) United States Patent
Divecha et al.

(10) Patent No.: US 7,090,893 B1
(45) Date of Patent: Aug. 15, 2006

(54) RHENIUM COMPOSITE

(75) Inventors: Amarnath P. Divecha, Falls Church, VA (US); Appajosula Srinivasa Rao, Bethesda, MD (US); William A. Ferrando, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 574 days.

(21) Appl. No.: 10/394,233

(22) Filed: Mar. 24, 2003

(51) Int. Cl.
*B05D 3/02* (2006.01)

(52) U.S. Cl. ..... 427/376.1; 427/376.2; 427/404; 427/419.1; 427/378

(58) Field of Classification Search ..... 427/376.1, 427/376.2, 402, 404, 419.1, 377, 378
See application file for complete search history.

(56) References Cited

U.S. PATENT DOCUMENTS

| | | | | | |
|---|---|---|---|---|---|
| 2,863,083 | A | | 12/1958 | Schram | |
| 3,819,971 | A | | 6/1974 | Kaplan et al. | |
| 3,901,663 | A | * | 8/1975 | Hofmann et al. | 428/594 |
| 3,982,148 | A | | 9/1976 | Kaplan et al. | |
| 4,196,230 | A | * | 4/1980 | Gibson et al. | 427/228 |
| 4,917,968 | A | | 4/1990 | Tuffias et al. | |
| 5,352,489 | A | * | 10/1994 | Ohara et al. | 427/250 |
| 5,577,263 | A | | 11/1996 | West | |
| 5,855,828 | A | | 1/1999 | Tuffias et al. | |
| 5,874,015 | A | | 2/1999 | Mittendorf et al. | |
| 5,875,228 | A | * | 2/1999 | Truszkowska | 378/144 |
| 5,935,351 | A | | 8/1999 | Sherman et al. | |
| 6,150,300 | A | * | 11/2000 | Khare et al. | 502/407 |

* cited by examiner

*Primary Examiner*—Bret Chen
(74) *Attorney, Agent, or Firm*—Jane Barrow

(57) ABSTRACT

A method of forming a rhenium layer on a substrate, comprising:

applying a solid rhenium-containing compound to a substrate;

reducing at a temperature above ambient temperature the rhenium-containing compound so that a rhenium layer is formed on the substrate; and optionally, repeating applying additional rhenium-containing compound on at least a section of the rhenium layer, and reducing at a temperature above ambient temperature the additional rhenium-containing compound so that a thicker layer of rhenium is formed.

18 Claims, 3 Drawing Sheets
(2 of 3 Drawing Sheet(s) Filed in Color)

RHENIUM COMPOSITE

BACKGROUND

1. Field of the Invention

This invention relates to a method of manufacturing a rhenium coating/film, more particularly to, a method of manufacturing a rhenium coating/film that can withstand a highly corrosive and erosive environment at a high temperature.

2. Description of the Prior Art

Some space and missile propulsion systems must withstand conditions that disrupt the structural integrity of the material. The temperature of the combustion products may be as high as 2,000° to 3,000° C. Brittle materials tend to fail rapidly because of an inability to withstand both structural and thermal shock. Premature failure because of cracking under shock or thermochemical failure greatly limits the useful life and reliability of an item, e.g., a missile nozzle or a gun tube.

The carbon fiber reinforced carbon matrix composites, i.e., carbon—carbon composite, are a light weight, high strength, refractory, structural material whose strength increases with temperature, even at temperatures in excess of 2,000° C. Carbon and carbon—carbon structural elements can be used at temperatures where other refractory materials have lost their practical strength. Unfortunately, carbon is susceptible to oxidation and erosion when exposed to oxidizing environments, even at moderate temperatures. Carbon is particularly vulnerable to oxidation in hostile environments and thus requires a protective coating.

Rhenium is a refractory metal that has been shown to successfully protect materials from erosive and corrosive environments. Rhenium can provide erosion resistance for components in high temperature rocket engines and hot gas valves. Rhenium has many advantages over other candidate liner materials. Rhenium has a high melting point of 3180° C./5756° F. exceeding all other metals except tungsten. Rhenium has a ductile-to-brittle transition temperature well below room temperature. With approximately 35% ductility as measured in elongation, and a tensile strength dropping from >1172 MPa (<170 ksi) at room temperature to >48 MPa (<7 ksi) at 2700° C., rhenium is virtually inert to thermal shock. Rhenium does not form a carbide and yet it does have a significant solubility for carbon that ensures excellent bond strength between the materials.

One previously used structure was composed of metallurgically bonded layers of platinum group metals such as ductile iridium and a refractory metal such as ductile rhenium that possesses both the high temperature corrosion resistance and the high temperature structural strength for high stress, high temperature applications, see, U.S. Pat. No. 4,917,968 to Tuffias et al., titled High Temperature Corrosion Resistant Composite Structure that issued on Apr. 17, 1990.

Increasing the thickness of the structure was originally believed as the means to increase the strength of the structure, particularly the thickness of the refractory metal layer. Increasing the thickness also increased the weight, the heat capacity, the cost and the difficulty of manufacturing the structure. Chemical vapor deposition, CVD, procedures were used to form successive layers of a structure under conditions such that the layers are bonded together by an interlayer, which is an admixture of the two adjacent layers. The metallurigically bonded iridium-rhenium structure described in this patent was capable of withstanding structural and thermal shock and the very high temperatures except that increasing the thickness did produce the undesirable results.

The usual method for applying a coating of rhenium to a substrate is by chemical vapor deposition, CVD. Rhenium pellets are exposed to a stream of chlorine gas in the presence of hydrogen gas in a reaction chamber at a temperature between 500° and 1200° C.

U.S. Pat. No. 5,577,263 to West discloses a chemical vapor deposition method in which a stream of gaseous rhenium hexafluoride flows onto a carbon substrate in the presence of a stream of sufficient hydrogen to cause a reduction of the rhenium hexafluoride to rhenium metal having an average grain diameter between 0.1 and 25 micrometers.

U.S. Pat. No. 5,874,015, titled Method for Making a Rhenium Rocket Nozzle to Mettendorf et al., issued on Feb. 23, 1999, discloses a method of depositing a number of layers of rhenium on a molybdenum mandrel. First, a layer of rhenium is deposited by CDV over the nozzle portion of the molybdenum mandrel, then rhenium wire is wrapped around the rhenium layer and then another layer of rhenium is deposited using CVD. Alternating layers are applied until a desired thickness is obtained. Finally, the molybdenum is etched away leaving the rhenium nozzle.

U.S. Pat. No. 5,855,828, titled Method of Forming a Composite Structure such as a Rocket Combustion Chamber, issued to Tuffias et al. on Jan. 5, 1999, discloses a carbon—carbon composite having a roughened dendritic surface of rhenium formed by CVD.

U.S. Pat. No. 5,935,351 to Sherman et al. for Method for Making a High Temperature, High Pressure, Erosion and Corrosion Resistant Composite Structure and issuing on Aug. 10, 1999, discloses depositing a layer of rhenium on a substrate by CVD. The composite formed was a gun barrel and rhenium was the corrosion and erosion resistant inner layer.

CVD is an expensive method for applying a layer of rhenium to substrates and a difficult method to use to control the thickness of the layer. There is a need for a cost effective, lightweight composite combustion chamber that will possess the high temperature structural strength for high stress, and can withstand the high temperature corrosive and erosive environment that the combustion chamber is subjected to during a period of high temperature.

In addition to the cost consideration, the CVD process becomes more complicated for the deposition of rhenium inside a nozzle or gun tube. The CVD process produces a coating on the exposed surface. The CVD process also requires additional treatments to produce rhenium film of different thicknesses.

OBJECTS OF THE INVENTION

Accordingly, one of the objects of the present invention is to provide a novel method for manufacturing a coating/film/layer of rhenium on a substrate.

Another object of the present invention is to provide a method for manufacturing a composite having a coating/film/layer of rhenium thereon by applying a solid rhenium-containing compound, e.g., salt or oxide, to the substrate and reducing the rhenium-containing compound.

A further object of the present invention is to provide a method for manufacturing a tailored coating/film/layer of rhenium at specific areas on a substrate.

A yet another object of the present invention is to provide a method for manufacturing a tailored coating/film/layer of rhenium film on a substrate by forming different thicknesses.

A still further object of the present invention is to provide a method for forming a coating/film/layer of rhenium on a substrate by applying a rhenium-containing compound in a slurry to specific areas of the substrate in order to obtain a desired thickness of rhenium, i.e., tailoring, reducing the rhenium-containing compound, e.g., $ReCl_4$ or $ReO_2$, in a hydrogen atmosphere within a temperature range above ambient temperature that is specific to that rhenium-containing compound, and forming a rhenium metal coating/film/layer and optionally, applying and reducing of the rhenium-containing compound repeatedly in order to increase the thickness of the rhenium metal coating/film/layer in specific areas on the substrate if desired, i.e., tailored thickness.

SUMMARY OF THE INVENTION

These and other objects of this invention are achieved in a preferred method of the invention by a method of forming a rhenium layer on a substrate, comprising: applying a solid rhenium-containing compound to a substrate; reducing at a temperature above ambient temperature the rhenium-containing compound so that a rhenium layer is formed on the substrate; and optionally, repeating applying additional rhenium-containing compound on at least a section of the rhenium layer, and reducing at a temperature above ambient temperature the additional rhenium-containing compound so that a thicker layer of rhenium is formed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

These and other objects, features and advantages of the invention, as well as the invention itself, will become better understood by reference to the following detailed description when considered in connection with the accompanying drawings wherein like reference numerals designate identical or corresponding parts throughout the several views, and wherein.

DETAILED DESCRIPTION OF THE INVENTION

Figure 1:
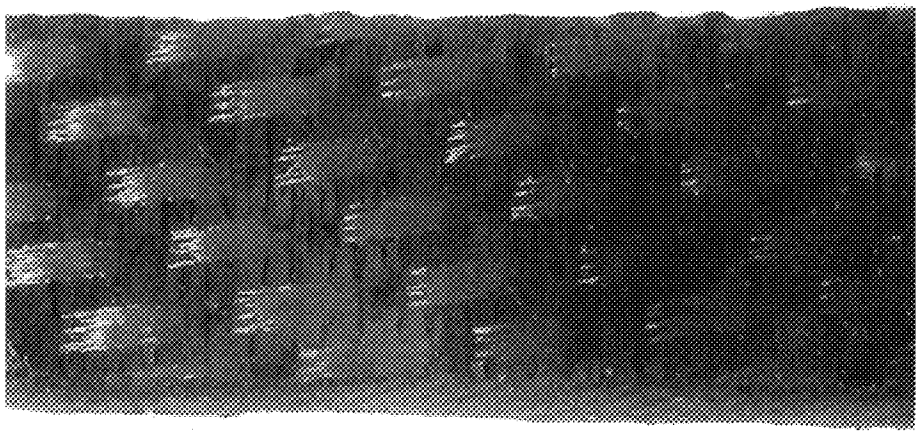
FIG. 1 is a photograph of a typically commercially available carbon—carbon composite surface.

Referring now to the drawings, the method of forming a coating/film/layer of rhenium on a substrate for use in high temperature, and highly corrosive and erosive environment involves the following operational steps:

The substrate structure should possess high strength and shock resistance at very high temperatures. Carbon reinforced carbon matrix composites are known to be lightweight, high strength, refractory structural materials whose strength increases with temperature, even at temperatures well in excess of 2,000° C. The high strength low-density load-bearing composite is preferably a carbon—carbon composite in which the matrix is a carbon. The term "carbon—carbon composite" as used herein will be understood by those skilled in the art to refer to and include a wide variety of carbonaceous materials. The composites have a melting point above the temperature that the reducing of said rhenium-containing compound occurs. The substrate is preformed into the its desired shape. The substrate does not require any pretreatment.

The refractory metal layer is only thick enough to prevent the migration of the hot gases, to absorb thermal shock and thermal stress, and to allow the flow of heat for dissipation by radiation. Thus, the mass and thickness of the refractory metal layer are minimized to do just that which is necessary to perform these functions. Insofar as possible, the required strength, in excess of that which is inherent in the thusly, minimized refractory metal layer, is provided by the carbon—carbon composite load bearing structure. The refractory metal can be a solid rhenium salt or a solid rhenium oxide. An example of a rhenium salt is $ReCl_4$ and an example of a rhenium oxide is $ReO_2$. Each of these rhenium-containing compounds can be commercially purchased, e.g., Alfa Aesara, 30 Bond Street, Ward Hill, Mass.

The rhenium-containing compound to be applied to the substrate, e.g., to the interior of a carbon—carbon nozzle, can be a particulate/powdered rhenium-containing compound in a slurry. A slurry is particulate material suspended in a liquid. The liquid in the slurry depends upon the rhenium-containing compound that is selected. It is suggested that an acid, e.g., concentrated HCl, be used if the rhenium-containing compound were a salt, e.g., $ReCl_4$, and a perioxide, e.g., $H_2O_2$, be used if the rhenium-containing compound were an oxide, e.g., $ReO_2$. A concentration in the slurry of 10:1 by weight of the rhenium-containing compound:liquid provides a suitable paste for application. It is desirable to have as thick a paste as possible depending upon the desired thickness of rhenium metal layer on the substrate.

The slurry is then pasted, applied, onto the substrate. Once the slurry has been applied to the surface of the substrate, more solid rhenium-containing compound can be applied, sprayed, either in a slurry or neat to the paste. The slurry can be applied to specific sites on the substrate depending on where the coating is desired and thickness desired, i.e., tailored. It might be desirable to have different thicknesses of rhenium on the substrate depending on the application/use. Thus, further applications of the slurry or powdered rhenium-containing compound can be applied at specific areas on the substrate thereby having provided rhenium films of different thicknesses, i.e., tailored thickness, of the paste on the substrate. The thickness of the paste layer can be about 10 μm to about 100 μm.

After applying the rhenium-containing compound onto the substrate as a slurry, the liquid is removed by low heat, e.g., at approximately 40° C. in a vacuum oven. After the liquid is removed, more rhenium-containing compound can be applied to the substrate by applying more slurry and/or more powdered rhenium-containing compound. The liquid can be removed by drying the substrate with the paste thereon in a vacuum oven at a low temperature, approximately 40° C. The paste and/or powdered rhenium-containing compound can be slowly built up until the desired thickness is obtained on the substrate at desired sites, i.e., tailored thickness.

Figure 2:
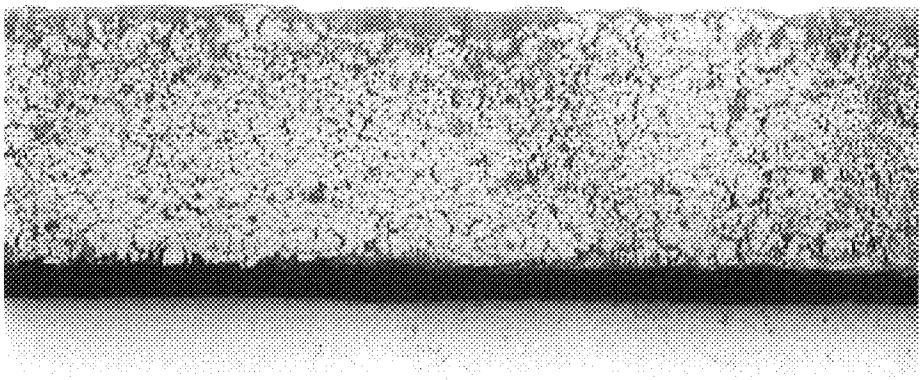
FIG. 2 is a photograph of a carbon—carbon composite surface with rhenium metal deposited thereon from the reduction of $ReCl_4$ at 550° C.
Figure 3:
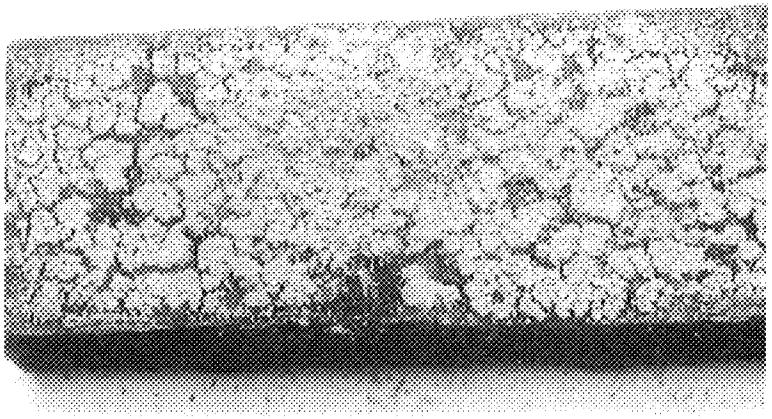
FIG. 3 is a photograph of a carbon—carbon composite surface with rhenium metal deposited thereon from the reduction of $ReO_2$ at 950° C.
Figure 4:
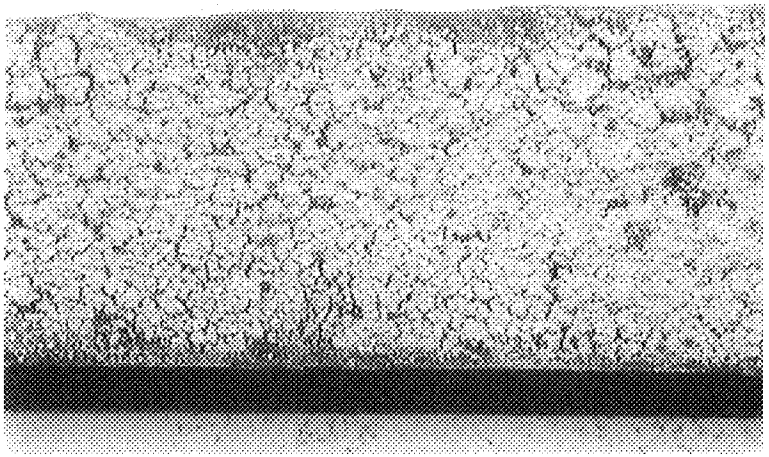
FIG. 4 is a photograph of a carbon—carbon composite surface with rhenium metal deposited thereon from the reduction of $ReO_2$ at 950° C.

The substrate having the rhenium-containing compound must be reduced in a hydrogen atmosphere at a high temperature in order to form a rhenium metal layer on the substrate. FIG. 1 is a photograph of a commercially available untreated carbon—carbon composite and FIGS. 2, 3 and 4 are photographs of a carbon—carbon composite having a rhenium film applied thereon. When $ReCl_4$ is used, the hydrogen reduces the rhenium salt to rhenium metal at a high temperature of about 550° to about 600° C. for two to three hours and the rhenium oxide at a high temperature of about 925° to 950° C. for two to three hours. The hydrogen flow rate can be at approximately 1–3 $ft^3$/hr. The rhenium coating/film/layer always appears like dried clay/mud layer on the substrate, see FIG. 2. Not to be held to a theory, it is felt that the liquid and gases are bubbling out of the paste and creating the appearance of the dried clay or mud coating/film/layer.

More rhenium-containing compound can be applied as the slurry onto at least a portion of the rhenium metal layer in order to increase the thickness of the resulting rhenium metal layer. This paste can also have more powdered rhenium-containing metal added in order to increase the thickness of the rhenium metal layer. The paste layer on the rhenium layer of the substrate can be dried in order to remove the liquid in a vacuum over at approximately 40° C. Finally, the additional rhenium-containing compound is reduced to rhenium metal by reduction process described above depending upon which rhenium-containing compound is used. Different applications of the rhenium-containing compound at differing sites on the substrate can provide for a non-uniform thickness of the rhenium layer, i.e., tailored thickness. The rhenium layer appears to look like dried mud.

EXAMPLE

In order to produce a uniform coating of rhenium film on carbon substrate, three different varieties of carbon materials were investigated. The carbon samples were commercial poco graphite, pyrographite and carbon—carbon composite material. All three samples were procured from commercial sources and the materials are of commercial grade. FIG. 1 shows a typical sample of carbon—carbon composite substrate. The samples were typically 1 inch in length×0.5 inch wide.

Rhenium chloride $ReCl_4$) and Rhenium Oxide ($ReO_2$) were also procured from a commercial source. The $ReCl_4$ powder was dispersed in conc. HCl acid. The ratio was 10 parts of $ReCl_4$ to 1 part of HCl (by weight). The rhenium oxide ($ReO_2$) powder was suspended in 35% hydrogen peroxide ($H_2O_2$) and conc. HCl. The ratio was the same as above (i.e. solid 10 parts to liquid 1 part by weight).

The suspensions ($ReCl_4$—HCl; $ReO_2$—HCl, $ReO_2$—$H_2O_2$) were applied to the carbon substrates. The samples were dried in a vacuum furnace at 50° C. for 2 hours. The samples were then introduced into a tube furnace.

The carbon substrate that was coated with $ReCl_4$—HCl was heated in flowing hydrogen atmosphere to 550° C. At 550° C., the furnace was maintained at a constant temperature within +2° C. for 2 hours. The sample was slowly cooled to room temperature in flowing hydrogen atmosphere. FIG. 2 shows a typical surface of rhenium-coated carbon—carbon composite that was produced via the $ReCl_4$ reduction process.

The carbon substrate that was coated with $ReO_2$—HCl was heated in flowing hydrogen atmosphere to 950° C. At 950° C., the furnace was maintained at a constant temperature within +2° C. for 2 hours. The sample was slowly cooled to room temperature in flowing hydrogen atmosphere. The sample was removed from the furnace and was subjected to a second coat of $ReO_2$—$H_2O_2$. The sample was dried and was reduced in hydrogen at 950° C. for 2 more hours. FIG. 3 shows a typical surface of rhenium-coated carbon—carbon composite that was produced via the $ReO_2$ reduction process. The FIG. 3 sample was subjected to two coatings.

The carbon substrate that was coated with $ReO_2$—$H_2O_2$ was heated in flowing hydrogen atmosphere to 950° C. At 950° C., the furnace was maintained at a constant temperature within +2° C. for 2 hours. The sample was slowly cooled to room temperature in flowing hydrogen atmosphere. FIG. 4 shows a typical surface of rhenium-coated carbon—carbon composite that was produced via the $ReO_2$ reduction process. This sample was subjected to one coating.

Figure 5:
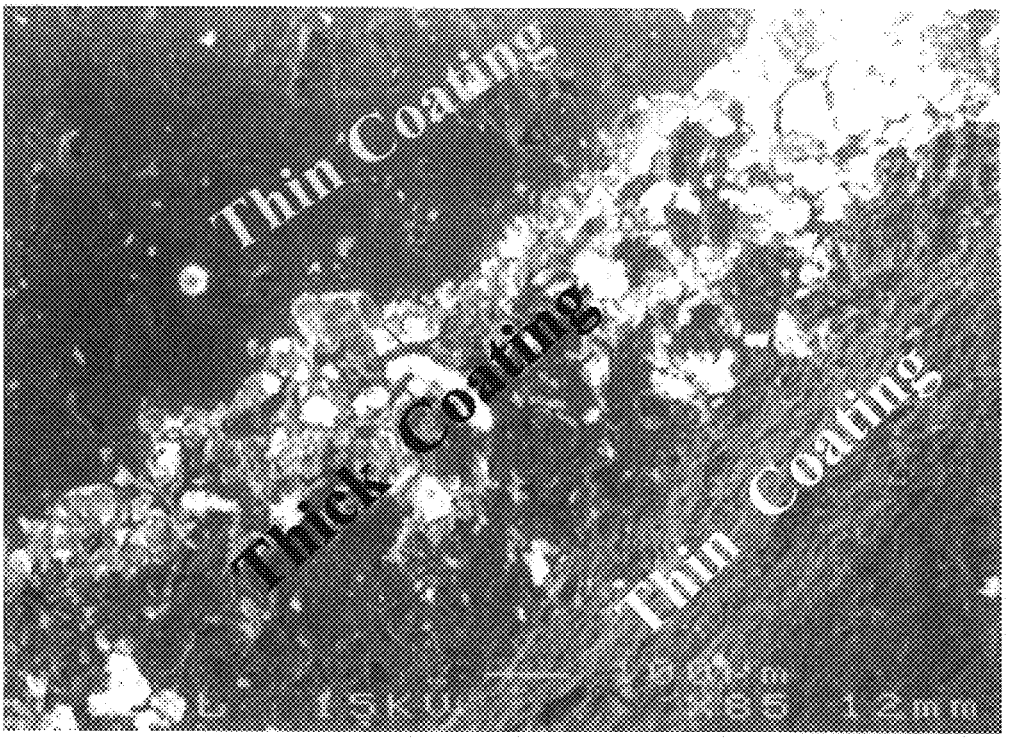
FIG. 5 is a photograph of a carbon—carbon composite surface with a tailored thickness of rhenium metal deposited thereon.
Figure 6:
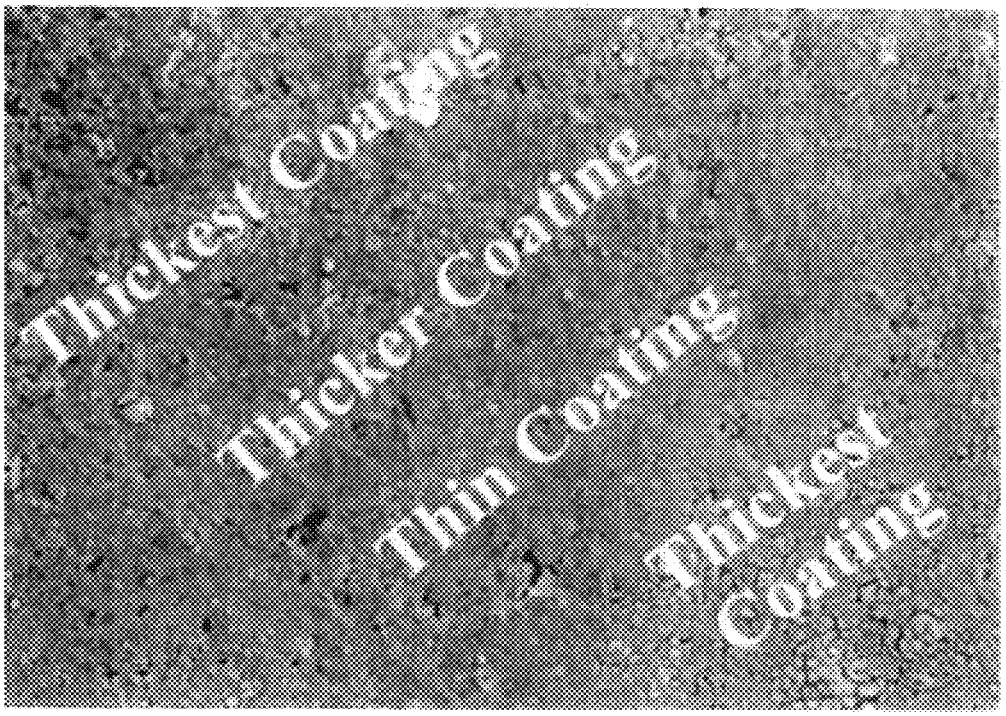
FIG. 6 is a photograph of a carbon—carbon composite surface with a tailored thickness of rhenium metal deposited thereon.

FIGS. 5 and 6 are photographs illustrating tailored thicknesses of rhenium metal on a carbon—carbon substrate.

The application of solid rhenium-containing compound to a substrate and its reduction to the rhenium metal film/coating/layer at a high temperature provides for a method that is less expensive than the previously used CVD method. In addition, the rhenium metal layer can be directed to specific sites on a substrate and there can be a tailored thickness to the rhenium metal layer so as to provide greater protection to the substrate to prevent erosion and corrosion of the substrate at extremely high temperatures and erosive and corrosive environment.

The invention claimed is:

1. A method of forming a rhenium layer on a substrate, comprising:

applying a solid rhenium-containing compound to a substrate;

reducing at a temperature above ambient temperature said rhenium-containing compound so that a rhenium layer is formed on said substrate; and optionally, repeating applying additional rhenium-containing compound on at least a section of said rhenium layer, and reducing at a temperature above ambient temperature said additional rhenium-containing compound so that a thicker layer of rhenium is formed, and wherein said rhenium-containing compound is $ReCl_4$.

2. The method of claim 1, wherein said rehenium-containing compound is applied in a slurry containing a liquid.

3. The method of claim 2, wherein said liquid is an acid.

4. The method of claim 3, wherein said liquid is concentrated hydrochloric acid.

5. The method of claim 2, wherein said slurry comprises a 10:1 by weight rhenium-containing compound:liquid.

6. The method of claims 2, further including:

removing said liquid from said slurry.

7. The method of claim 1, wherein hydrogen is used to reduce said rhenium-containing compound.

8. The method of claim 1, wherein said rhenium layer has a thickness of from about 10 μm to about 100 μm.

9. The method of claim 1, wherein said reducing is at said temperature of from about 550°to about 600° C. for about 2 to about 3 hours.

10. The method of claim 1, wherein said substrate has a melting point above said temperature that said reducing of said rhenium-containing compound occurs.

11. A method of forming a rhenium layer on a substrate, comprising:

applying a solid rhenium-containing compound to a substrate;

reducing at a temperature above ambient temperature said rhenium-containing compound so that a rhenium layer is formed on said substrate; and optionally, repeating applying additional rhenium-containing compound on at least a section of said rhenium layer, and reducing at a temperature above ambient temperature said additional rhenium-containing compound so that a thicker layer of rhenium is formed, and wherein said rhenium-containing compound is $ReO_2$, and wherein said $ReO_2$ is applied in a slurry containing hydrogen peroxide.

12. The method of claim 11, wherein said reducing is at said temperature of from about 925° to about 950° C. for about 2 to about 3 hours.

13. The method of claim 11, wherein said slurry comprises a 10:1 by weight rhenium-containing compound: liquid.

14. The method of claim 11, wherein hydrogen is used to reduce said rhenium-containing compound.

15. The method of claim 11, wherein said rhenium layer has a thickness of from about 10 μm to about 100 μm.

16. The method of claim 11, further including:

removing said liquid from said slurry.

17. The method of claim 11, wherein said substrate has a melting point above said temperature that said reducing of said rhenium-containing compound occurs.

18. A method of forming a rhenium layer on a carbonaceous material composite, comprising:

applying a slurry containing a solid rhenium-containing compound selected from the group consisting of a rhenium salt and a rhenium oxide, and a liquid to a carbonaceous material to form a layer of solid rhenium-containing compound in said liquid on said substrate;

heating at a low temperature said rhenium-containing layer to remove said liquid;

reducing at a temperature of from about 550° to about 950° C. for about 2 to about 3 hours said rhenium-containing compound so that a rhenium layer is formed on said substrate; and optionally, repeating applying additional rhenium-containing compound on at least a section of said rhenium layer, and reducing at said temperature of said additional rhenium-containing compound so that a layer of rhenium is formed, and wherein said slurry comprises a 10:1 by weight rhenium-containing compound:liquid, and wherein said rhenium-containing compound is $ReCl_4$.

* * * * *